US006624389B1

(12) United States Patent
Cox

(10) Patent No.: US 6,624,389 B1
(45) Date of Patent: Sep. 23, 2003

(54) METHOD OF FABRICATING A METAL STEP SHELF TRAY

(76) Inventor: Bruce W. Cox, 701 1st Ave., N., Altoona, IA (US) 50009

( * ) Notice: Subject to any disclaimer, the term of this patent is extended or adjusted under 35 U.S.C. 154(b) by 0 days.

(21) Appl. No.: 10/119,055

(22) Filed: Apr. 9, 2002

(51) Int. Cl.[7] ..... B23K 9/00; B21D 39/02
(52) U.S. Cl. ..... 219/137 R; 219/75; 29/428
(58) Field of Search ..... 219/137 R, 75; 29/428, 401.1

(56) References Cited

U.S. PATENT DOCUMENTS

| | | | | | |
|---|---|---|---|---|---|
| 3,653,516 | A | * | 4/1972 | Herbert | 211/43 |
| 3,834,325 | A | * | 9/1974 | DeWilde | 108/96 |
| 4,040,588 | A | * | 8/1977 | Papsco et al. | 248/245 |
| 4,450,970 | A | * | 5/1984 | Shepherd | 211/189 |
| 4,518,279 | A | * | 5/1985 | Suttles | 403/231 |
| 4,575,164 | A | * | 3/1986 | Pinnow et al. | 312/350 |
| 4,779,720 | A | * | 10/1988 | Mandelbaum | 206/756 |
| 5,815,903 | A | * | 10/1998 | Foster et al. | 29/401.1 |
| 6,234,068 | B1 | * | 5/2001 | Sherman | 99/449 |

* cited by examiner

*Primary Examiner*—Tom Dunn
*Assistant Examiner*—Len Tran
(74) *Attorney, Agent, or Firm*—Sturm & Fix LLP

(57) ABSTRACT

A method of fabricating a metal step shelf tray that has a series of trays at stepped elevated heights. The method includes providing a planar sheet of stainless steel and cutting a planar blank from the sheet. The planar blank includes a number of tray panel sections spaced from each other, a riser panel section between adjacent pairs of tray panel sections, and a pair of side panel sections extending out from opposite sides of each tray panel section. The planar blank may further include end riser sections extending from the free ends of the planar blank, and lower lip sections extending out from each of the side panel sections. The planar blank is then formed by a series of bending operations where the lower lip sections are directed perpendicular to their adjacent side panel sections; and the side panel sections, rise panel sections, and end riser sections are directed perpendicular to their adjacent tray panel sections. The bending operations result in a bent blank with a number of linear abutting edges of adjacent side and riser panels that are then welded together by TIG welding.

13 Claims, 8 Drawing Sheets

60
70
20
30
40
70
20
32
40
20
34
70
50

50
20
34
70
5
40
20
32
70

60
70
20
30
5
40

METHOD OF FABRICATING A METAL STEP SHELF TRAY

BACKGROUND OF THE INVENTION

1. Field of the Invention

The present invention relates to the field of metal fabrication, and more particularly to a method of fabricating a metal step shelf tray.

2. Description of Related Art

Step shelf trays, such as those used in delicatessen display cases, are typically fabricated from stainless steel of an acceptable grade. The method includes bending a rectangular blank of stainless steel to form a series of horizontal tray sections interconnected by vertical riser sections, cutting a pair of planar side panels with stepped elevations corresponding to the tray sections, and then welding the side panels to the bent blank along the abutting edges which extend along the entire length of both side edges of the bent blank. This method has several disadvantages that adversely affect the cost and quality of the finished step shelf trays. The cost is high since there are long weld lines on both sides of the trays which require expensive TIG welding materials and processing time. Also, the quality of the finished tray is compromised since the long weld lines tend to produce tray surfaces that flex exhibiting an oil can effect.

While the aforementioned prior art method of fabricating may produce a tray that is adequate for the basic purpose and function for which it has been specifically designed, it is deficient with respect to it's failure to provide a simple, efficient, and practical method of fabricating a metal step shelf tray.

As a consequence of the foregoing situation, there has existed a longstanding need for a new and improved method of fabricating a metal step shelf tray, and the provision of such a, method is a stated objective of the present invention.

BRIEF SUMMARY OF THE INVENTION

Briefly stated, the present invention provides a method of fabricating a metal step shelf tray that.:has a series of trays at stepped elevated heights. The method includes providing a planar sheet of stainless steel and cutting a planar blank from the sheet. The planar blank includes a number of tray panel sections spaced from each other, a riser panel section between adjacent pairs of tray panel sections, and a pair of side panel sections extending out from opposite sides of each tray panel section. The planar blank may further include end riser sections extending from the free ends of the planar blank, and lower lip sections extending out from each of the side panel sections. The planar blank is then formed by a series of bending operations where the lower lip sections are directed perpendicular to their adjacent side panel sections; and the side panel sections, rise panel sections, and end riser sections are directed perpendicular to their adjacent tray panel sections. The bending operations result in a bent blank with a number of linear abutting edges of adjacent side and riser panels that are then welded together by TIG welding.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
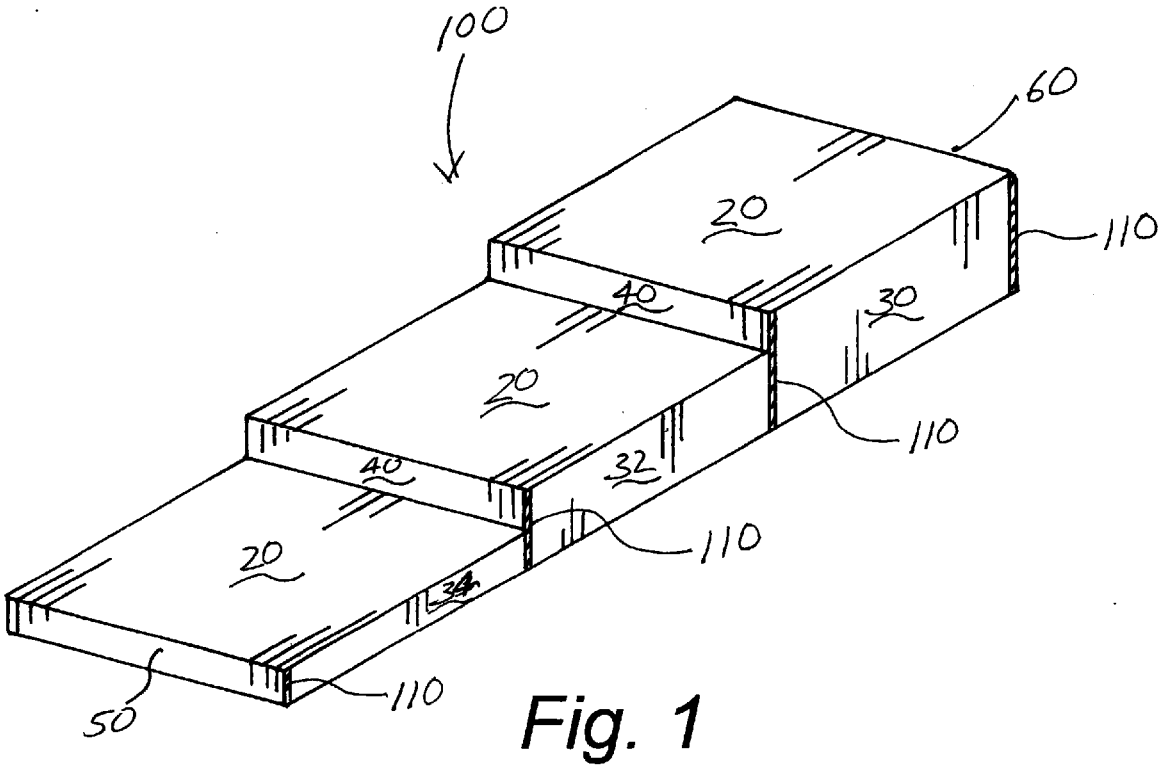
FIG. 1 is a perspective view of a step shelf tray fabricated by the method of the present invention.

As can be seen by reference to the drawings, and in particular to FIG. 1, a metal step tray fabricated by the method that forms the basis of the present invention is designated generally by the reference number 100.

The step shelf tray 100 depicted has tray panel sections 20 disposed at three discrete stepped elevated heights, and has vertical weld lines 110 extending vertically down from the front and rear corners of each of the trays 20 along the abutting edges of adjacent side panels 30, 32, 34, and the intermediate riser panels 40 and end riser sections 50 and 60.

Figure 2:
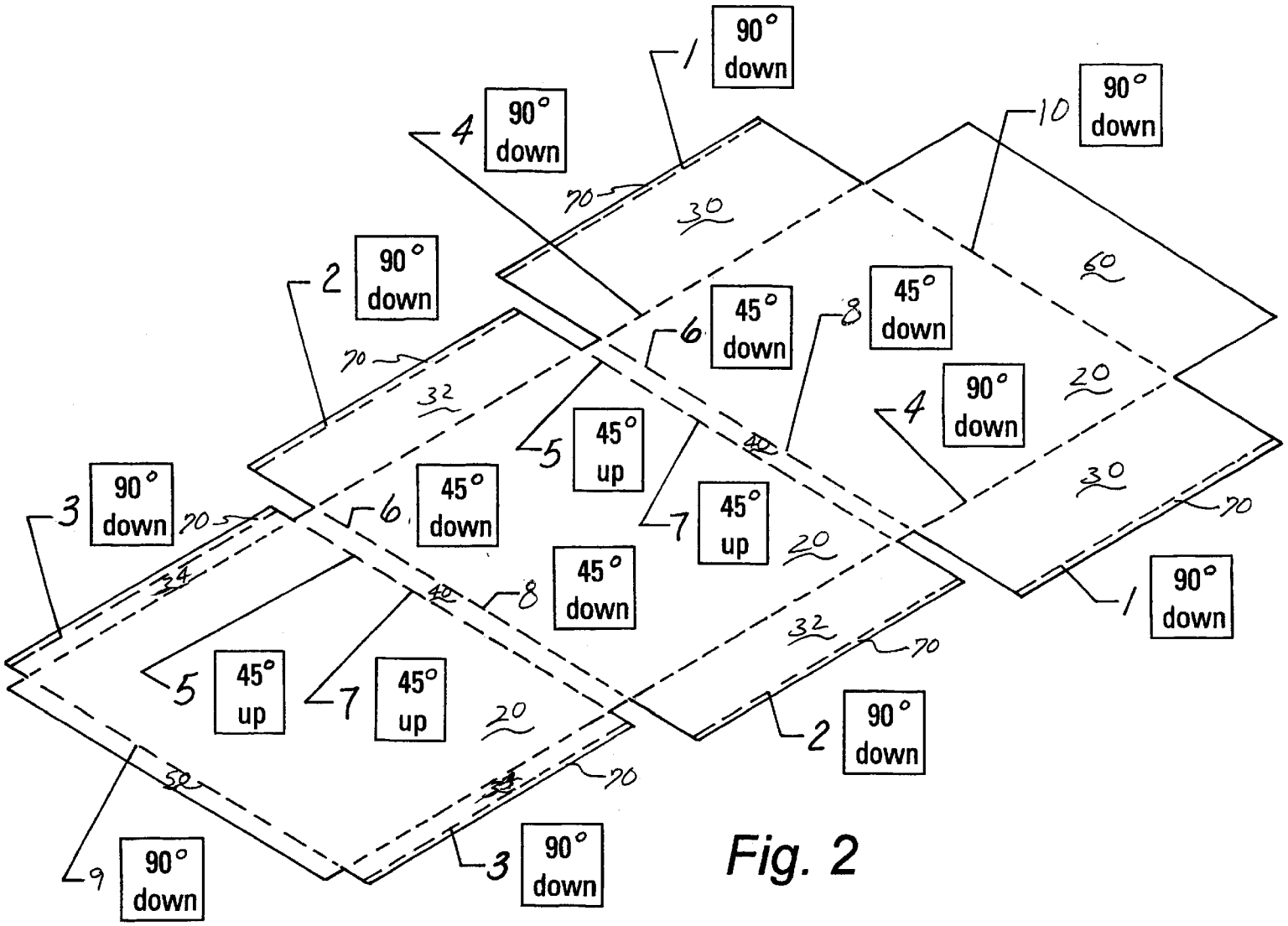
FIG. 2 is a perspective view of a planar blank cut from a planar sheet of metal such as stainless steel, wherein the sequential bending operations are indicated.

FIG. 2 shows a planar blank that has been cut from a planar sheet of metal such as stainless steel. The planar blank includes tray panel sections 20; side panel sections 30, 32, 34; intermediate riser panel sections 40; a low elevation end riser section 50; a high elevation end riser section 60; and lower lip sections 70. The reference numerals 1 through 10 of FIG. 2 indicate the sequence of the bending operations performed, and an associated legend indicates the direction and extent of each of the sequential bends 1 through 10.

Figure 3:
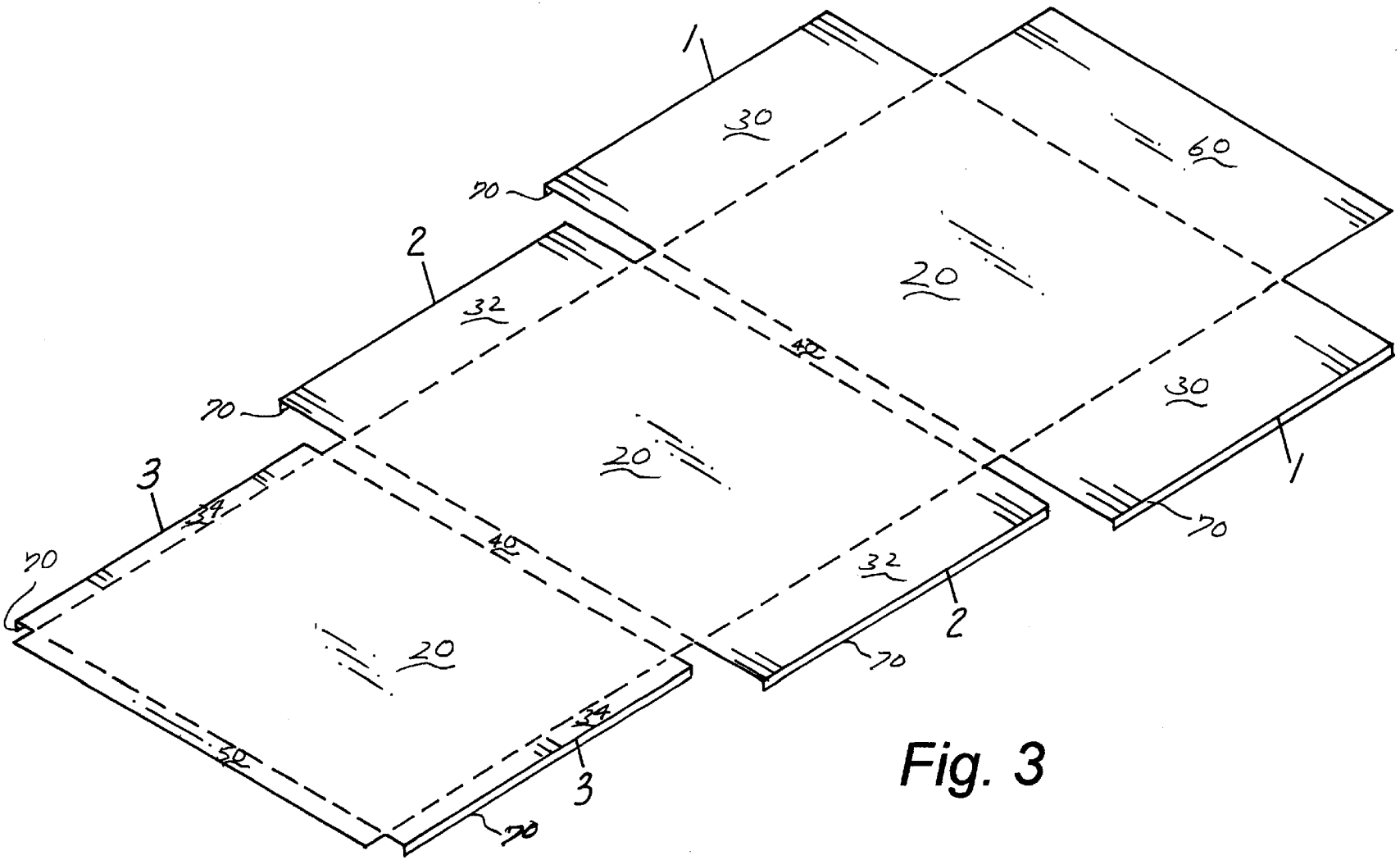
FIG. 3 is a perspective view showing the blank after the first, second, and third bending operations are completed.
Figure 4:
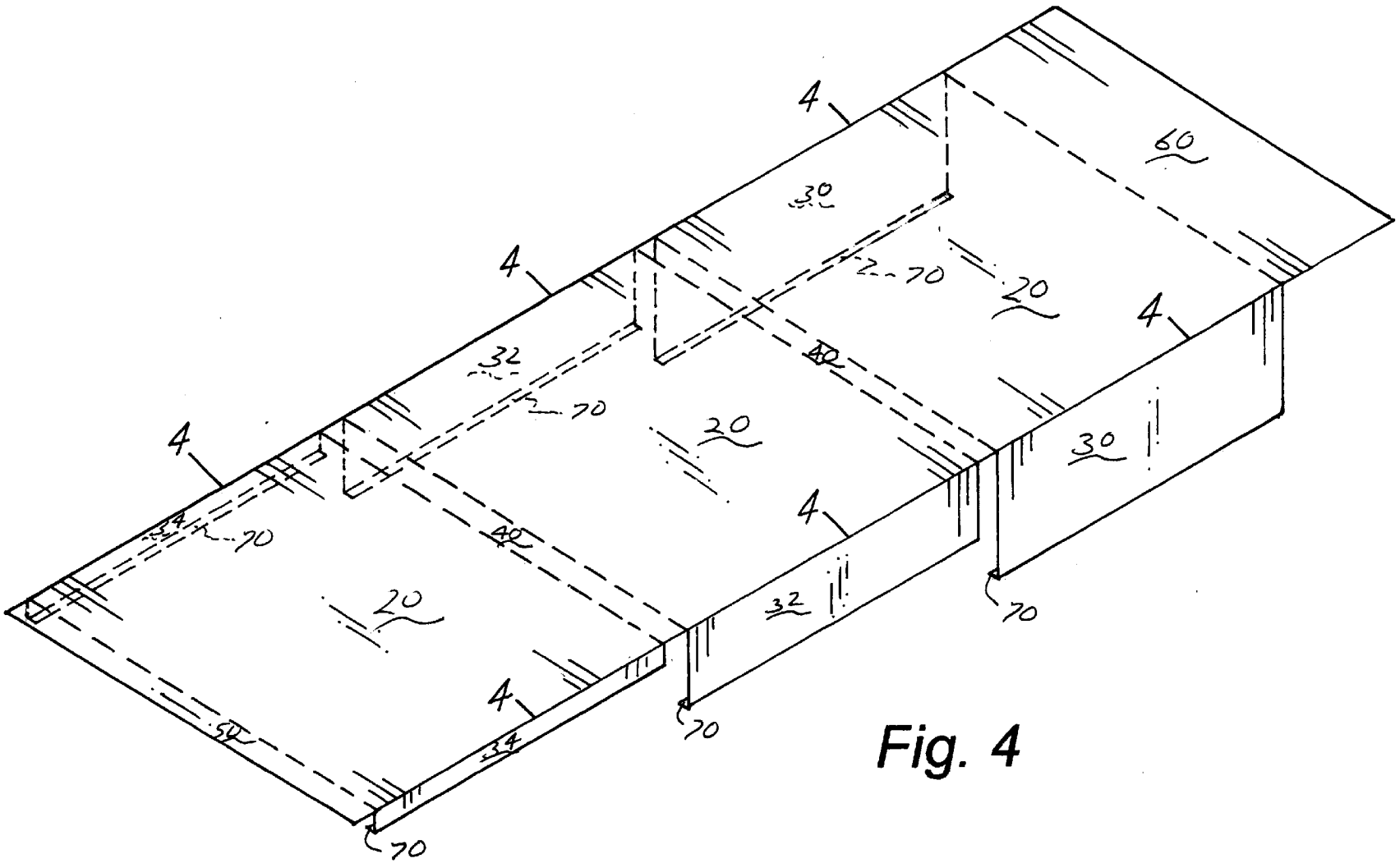
FIG. 4 is a perspective view showing the blank after the fourth bending operation is completed.
Figures 5, 6:
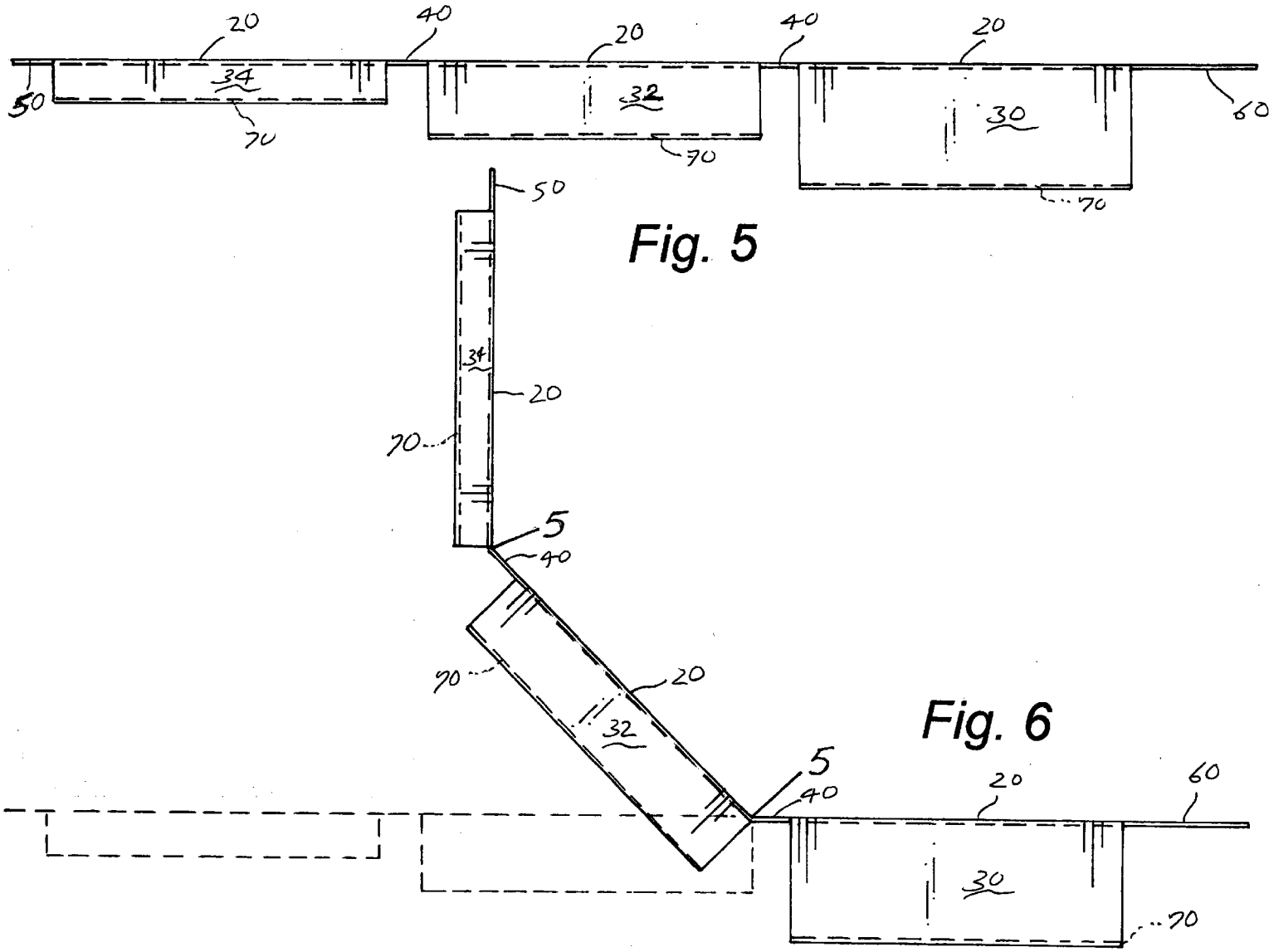
FIG. 5 is a side elevational view showing the blank after the fourth bending operation is completed.
FIG. 6 is a side elevational view showing the blank after the fifth bending operation is completed.
Figure 7:
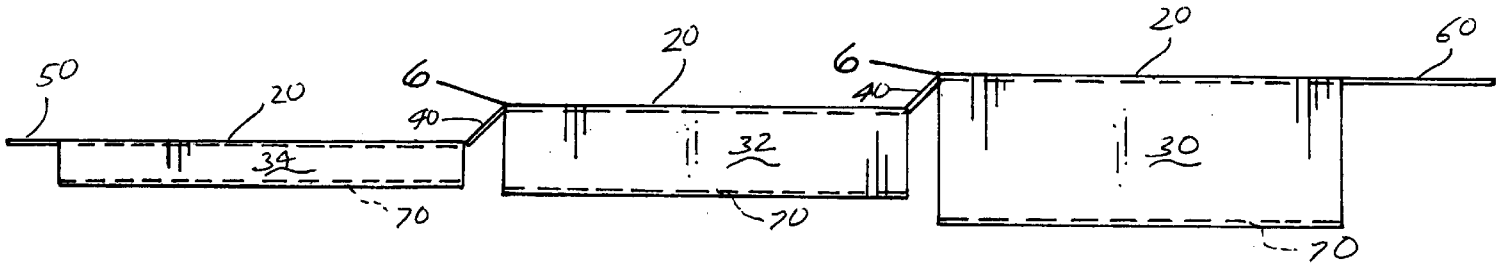
FIG. 7 is a side elevational view showing the blank after the sixth bending operation is completed.
Figure 8:
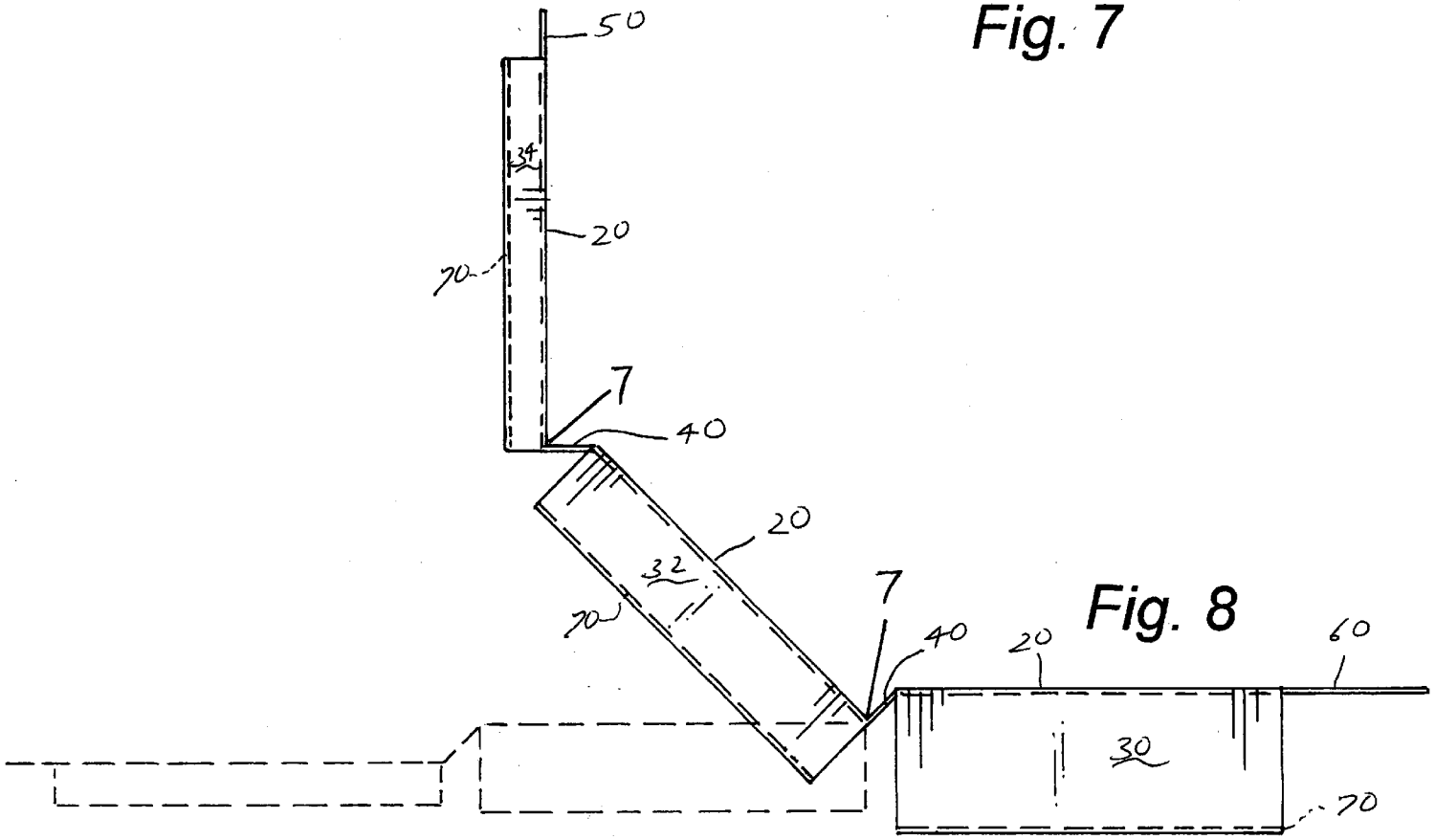
FIG. 8 is a side elevational view showing the blank after the seventh bending operation is completed.
Figure 9:
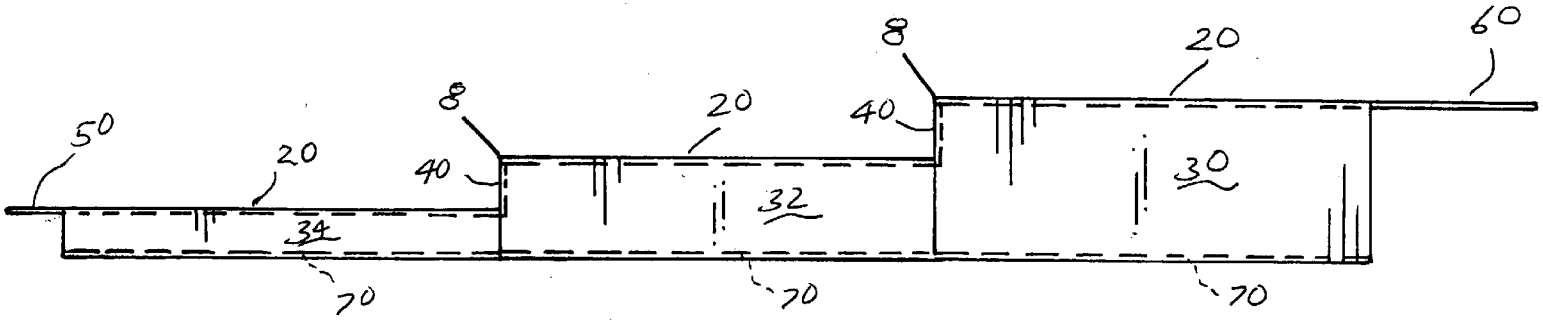
FIG. 9 is a side elevational view showing the blank after the eighth bending operation is completed.
Figure 10:
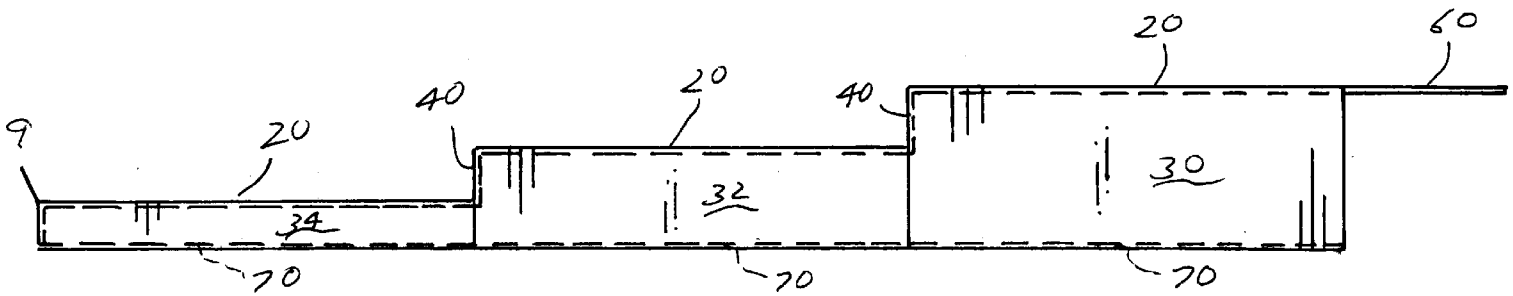
FIG. 10 is a side elevational view showing the blank after the ninth bending operation is completed.
Figure 11:
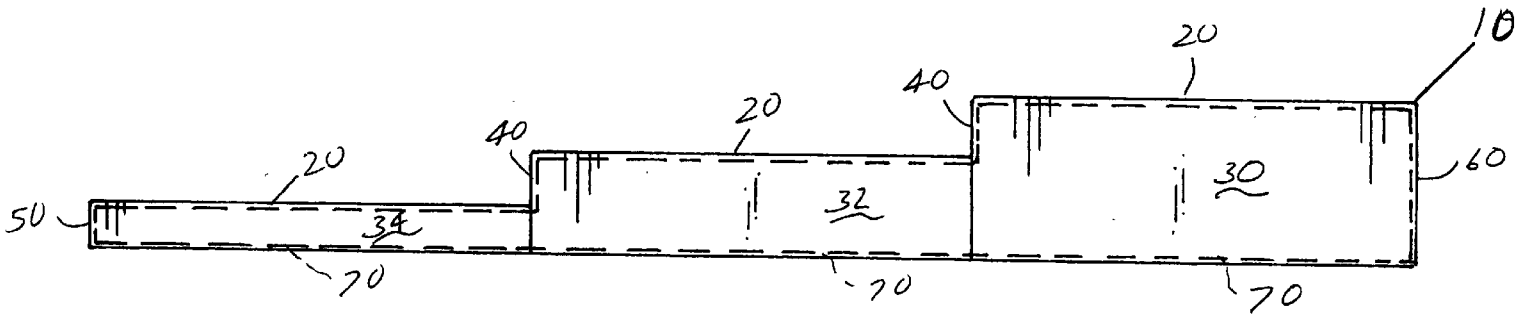
FIG. 11 is a side elevational view showing the blank after the tenth bending operation is completed.

FIG. 3 shows the bent blank after bends 1, 2, and 3 have been completed where the lower lip 70 is bent downward at 90° to side panels 30, 32, and 34, respectively. FIGS. 4 and 5 show the bent blank after bend 4 where side panels 30, 32, and 34 are bent down at 90° to their associated tray panels 20. FIG. 6 illustrates bend 5 where the two lower tray panels 20 are bent up 45° with respect to their adjacent riser panels 40. FIG. 7 shows the bent blank after bend 6 has been made where the two upper tray panels 20 are bent down 45° with respect to their adjacent riser panels 40. FIG. 8 illustrates bend 7 where the two lower tray panels 20 are bent up an additional 45° with respect to their adjacent riser panels 40. FIG. 9 shows the bent blank after bend 8 where the two upper tray panels 20 are bent down an additional 45° to their adjacent riser panels 40. FIG. 10 illustrates bend 90° where the lower end riser 50 is bent down 900 with respect to the lowermost tray panel 20. FIG. 11 shows the final bend 10 after the higher end riser 60 is bent down 90° with respect to the uppermost tray panel 20.

Bending operations 1 through 10 result in the bent blank shown in FIG. 11 where there are linear abutting edges on each side of high end riser 60 and side panel 30; side panels 30, 32, and riser 40; side panels 32, 34, and riser 40; and low end riser 50 and side panel 34. These linear abutting edges are then joined by TIG welding and result in the vertical weld lines 110 shown in FIG. 1.

Figure 12:
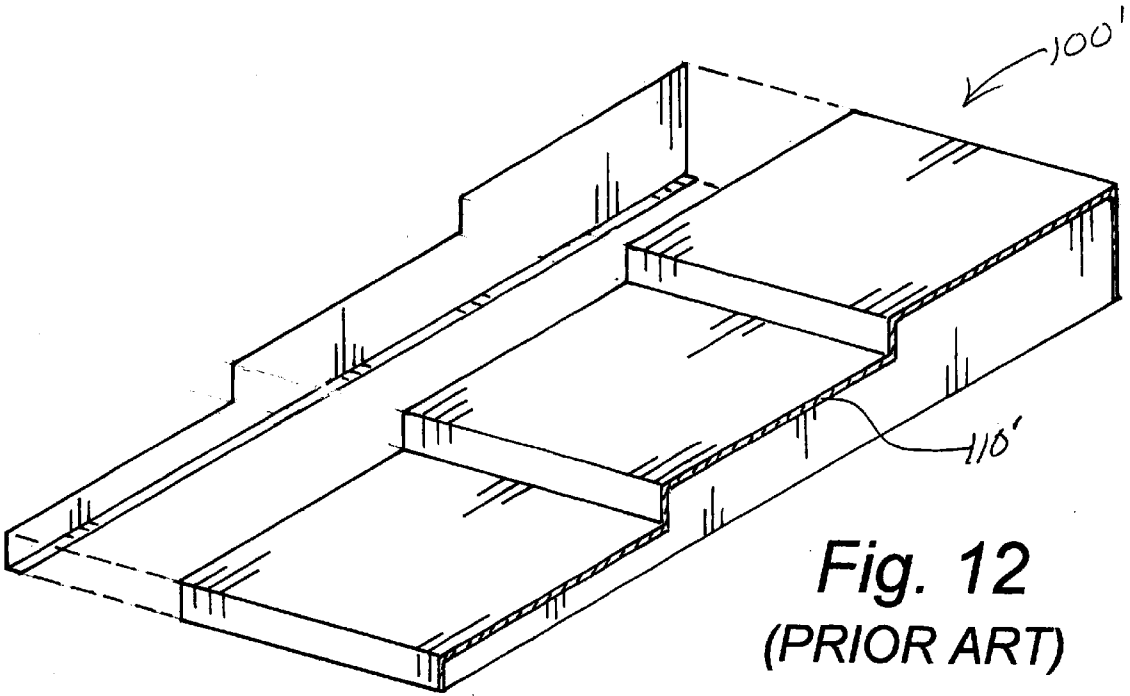
Fig. 12 (PRIOR ART)
FIG. 12 is a perspective view showing a step shelf tray fabricated by a method known in the prior art.

Comparing the step shelf tray 100 shown in FIG. 1 to the prior art step shelf tray 100' shown in FIG. 12, it can be seen that the total length of the weld lines 110 is substantially less than the length of the weld line 110'. This results in substantial savings over the prior art by cutting the welding material and time required by about two-thirds, which translates to an overall production cost savings of about one-third. Further, since the weld line along the top edge of the tray panel 20 is virtually eliminated, the flexing, or oil can effect, of the tray panel 20 is avoided.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A method of fabricating a metal step shelf having a series of trays at stepped elevated heights, comprising the steps of:

providing a planar sheet of metal;

cutting a planar blank from the sheet, the blank including:

a plurality of tray panel sections disposed in spaced relationship to each other;

a riser panel section disposed between adjacent pairs of tray panel sections;

a pair of side panel sections disposed outwardly from opposite sides of each tray panel section, each side panel section having a length equal to a predetermined elevated height of the associated tray panel section;

bending the planar blank to direct the riser panel sections and side panel sections perpendicular to the tray panel sections resulting in a plurality of linear abutting edges of adjacent side panels and an intermediate riser panel; and joining the linear abutting edges by welding.

2. The method of claim 1 wherein the planar blank includes an end riser section disposed between a tray panel section and a free end of the planar blank and wherein the process includes bending the end riser section to direct it perpendicularly to the tray panel section resulting in linear abutting edges of the end riser panel and its adjacent side panel.

3. The method of claim 2 wherein the end riser section is disposed adjacent the tray panel section having the lowest elevated height.

4. The method of claim 2 wherein the end riser section is disposed adjacent the tray panel section having the highest elevated height.

5. The method of claim 2 further including a second end riser section disposed adjacent the tray panel section having the highest elevated height.

6. The method of claim 1 wherein the planar blank includes a lower lip section disposed outwardly from each of the side panel sections, and wherein the planar blank is bent to direct the lower lip sections perpendicular to the side panel sections.

7. The method claim 2 wherein the planar blank includes a lower lip section disposed outwardly from each of the side panel sections, and wherein the planar blank is bent to direct the lower lip sections perpendicular to the side panel sections.

8. The method of claim 3 wherein the planar blank includes a lower lip section disposed outwardly from each of the side panel sections, and wherein the planar blank is bent to direct the lower lip sections perpendicular to the side panel sections.

9. The method of claim 4 wherein the planar blank includes a lower lip section disposed outwardly from each of the side panel sections, and wherein the planar blank is bent to direct the lower lip sections perpendicular to the side panel sections.

10. The method of claim 5 wherein the planar blank includes a lower lip section disposed outwardly from each of the side panel sections, and wherein the planar blank is bent to direct the lower lip sections perpendicular to the side panel sections.

11. The method of claim 6 wherein the planar blank includes a lower lip section disposed outwardly from each of the side panel sections, and wherein the planar blank is bent to direct the lower lip sections perpendicular to the side panel sections.

12. The method of claim 1 wherein the planar sheet of metal is stainless steel.

13. The method of claim 12 wherein the linear abutting edges are joined by TIG welding.

* * * * *